United States Patent [19]

Drabert et al.

[11] 3,938,858

[45] Feb. 17, 1976

[54] CHAIR WITH ADJUSTABLE BACKREST

[76] Inventors: Fritz Drabert, Marienstr. 37; Klaus Geffers, Goethestr. 26, both of 495 Minden, Germany

[22] Filed: Dec. 2, 1974

[21] Appl. No.: 528,614

[30] Foreign Application Priority Data

Dec. 3, 1973 Germany ..... 2360165

[52] U.S. Cl. ..... 297/284; 297/355

[51] Int. Cl.[2] ..... A47C 3/00

[58] Field of Search ..... 297/284, 354, 355, 361

[56] References Cited

UNITED STATES PATENTS

| | | | |
|---|---|---|---|
| 855,656 | 6/1907 | McNamara et al. | 297/284 |
| 2,258,119 | 10/1941 | Mathe et al. | 297/284 |
| 3,588,172 | 6/1971 | McGregor | 297/355 |

*Primary Examiner*—James C. Mitchell

*Attorney, Agent, or Firm*—Pollock, Vande Sande & Priddy

[57] ABSTRACT

A chair having an adjustable backrest wherein the backrest comprises a backplate and a backrest member and with the backplate being pivotally supported relative to the said seat. An adjusting member is provided for varying the space between at least one part of the backrest member relative to the backplate as the angle of inclination of the backrest varies relative to the seat.

12 Claims, 2 Drawing Figures

CHAIR WITH ADJUSTABLE BACKREST

BACKGROUND OF THE INVENTION

Chairs are known which have frames in the form of a curved backplate to which a backrest cushion is secured. The backrest cushion stretches from the seat cushion to the top edge of the backplate. When the backplate is moved back and forth, the backrest cushion moves with it, being displaced to a greater extent in the upper region than in the lower because of the chosen position of the pivot at the base. The movement achieves only a slight change in the depth of the seat in the lower region, and the user is obliged to incline the body according to the position of the backrest. Consequently, the optimal body inclination is not possible in all backrest positions. For example, when the backrest is pivoted to its most forward position, it is not possible to adopt a relaxed upright posture because the edge of the backrest extends too far forward at the top.

SUMMARY OF THE INVENTION

An object of the invention is to avoid the disadvantages of the known chairs and to provide a chair of the type mentioned above in which a relaxed, upright posture is possible in all backrest positions. This object is achieved according to the invention in that an adjusting means is provided on the backplate, which is arranged to simultaneously adjust the horizontal distance of at least one zone of the backrest relative to the backplate depending upon the backplate angle of inclination. With such an arrangement, the lower portion of the backrest padding automatically experiences a greater forward movement than the mere angular movement of the backplate itself in this zone as the backplate moves forwardly. Similarly, a backward movement of the backplate results in greater backward displacement of the backrest lower portion than that of the backplate in this zone. The backrest effects a forward positioning of the pelvis, thus supporting the sacrolumbar area of the back in a manner beneficial to the health of the user. In a preferred embodiment of the invention, the lower end of the backrest is provided with a means which draws this portion against the backplate.

This invention can be used to special advantage when the supporting frame is of the known, curved-plate type.

The adjusting means of one suitable embodiment of the invention is provided with at least one substantially vertically rod pivoted to a fixed point and secured at its upper end to a crossbar, arranged at right-angles to the plane of pivot, and in contact with a guide means which is mounted on the backplate, so that the crossbar is moved relative to the backplate, taking with it at least one portion of the backrest whenever the backplate is pivotally adjusted.

A variety of shapes and angles can be used for the guide means. The desired support and movement of the backrest in relation to the inclination of the backplate may be attained by selecting a suitable form and location for the guide means. An especially simple construction provides a guide means having a downwardly sloping guide surface.

It has proved advantageous to arrange the pivot point of the rod behind that of the backplate.

With one suitable embodiment, the means of adjustment comprises two parallel rods, connected by a crossbar with bent-over ends which support the backrest, whereby the guide means are arranged between the two rods. The rods may be pivoted to a lug on the seat frame.

Principally, two different embodiments of the backrest are possible. With the first embodiment, the backrest is provided with a rigid backboard. The result of providing a rigid backboard is that the horizontal curvature of the backrest remains unchanged during adjustment. In a second embodiment, the backrest is in itself flexible. With such an embodiment, the curvature is altered during adjustment in that the zone affected by the bow of the crossbar is moved to a greater extent than the other zones of the backrest.

The upper edge is pivoted to provide pivotal movement between the backrest and the backplate. A suitable means for drawing back the base of the backrest is an elastic tape.

BRIEF DESCRIPTION OF THE DRAWINGS

In the following, preferred embodiments of the invention are described in detail with the aid of the drawings which show.

DETAILED DESCRIPTION OF THE PREFERRED EMBODIMENTS

Figure 1:
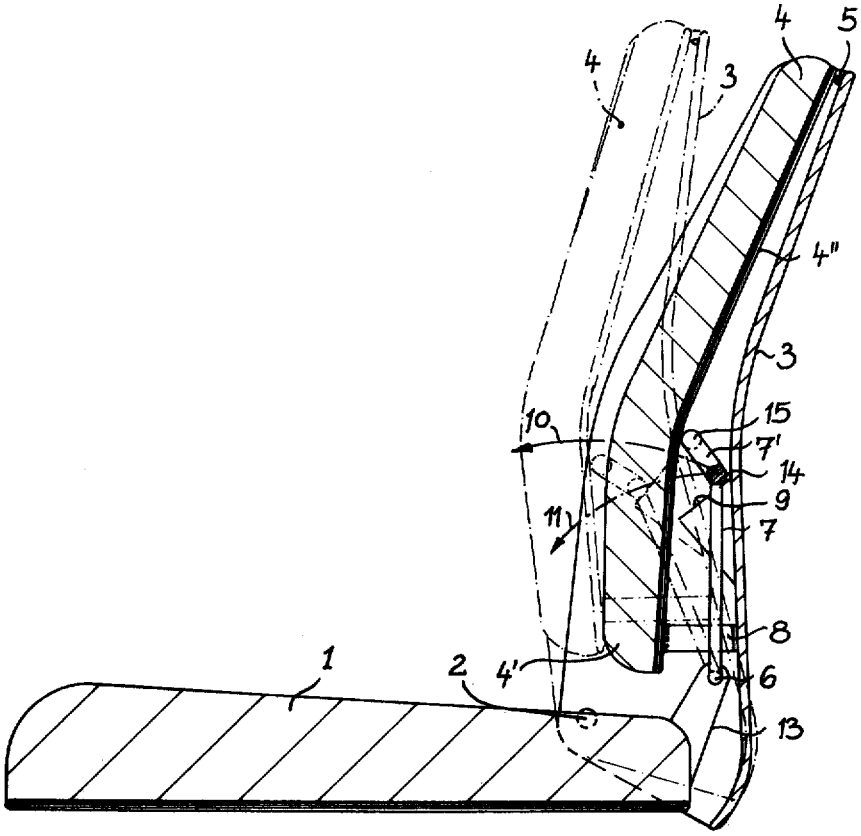
FIG. 1 is a longitudinal section through a first embodiment of the invention with two inclinations of the backrest and the backplate, the backrest having a rigid backboard.

Referring to FIG. 1, a supporting frame 3 in the form of a curved backplate is shown as being pivoted at pivot point 2 to the seat 1. The backrest cushion 4 is mounted on the curved backplate 3 at pivot point 5. The backrest 4 is backed by a curved, rigid backboard 4''. Two lugs 13, arranged next to each other, are provided on the frame of the seat 1, of which only one is visible in the drawing. Two parallel rods 7 are vertically pivoted to the lugs at pivot point 6. The two rods 7 are connected by means of a crossbar 7' the bent-over ends of which contact the backboard 4''. The crossbar 7' rests upon the guide surface 9 which is connected to the backplate 3 and, in the depicted example, slopes downwardly towards the front.

The uppermost point of the guide surface 9 on the backplate 3 describes the arc indicated by arrow 10, when the backrest is pivotally moved. The center of this arc is the pivot 2. The crossbar 14 describes the arc shown by arrow 11 having as its center the pivot 6 of the rod 7.

In the position shown in full lines, the crossbar 7' is at its nearest point to the backplate 3. When the broken-line position is assumed, the crossbar 7' slides down the guide surface 9 and, simultaneously, moves forward a distance, thus increasing the space between the backboard 4'' and the backplate 3. When this happens, the elastic tape 8 which draws the lower zone 4' of the backrest 4 towards the backplate, is extended.

The adjusting means, comprising rods 7, crossbar 7', and guide surface 9 has thus displaced the lower zone 4' of the backrest 4 to a greater extent than the mere pivoting of the backplate would achieve. This provides an especially beneficial supporting of the lower spinal zone, and a healthy posture for the user due to the forward positioning of the pelvis.

Displacement of the lower zone 4′ of the backrest 4 occurs over the entire pivotal arc of the backplate 3 and can be influenced by the shape and position of the guide surface to perform in a desired manner.

When the backplate 3 is pivoted rearwardly, the elastic tape 8 draws the backrest into its original position. The adjusting means is thereby also urged into the original position depicted in full lines.

Figure 2:
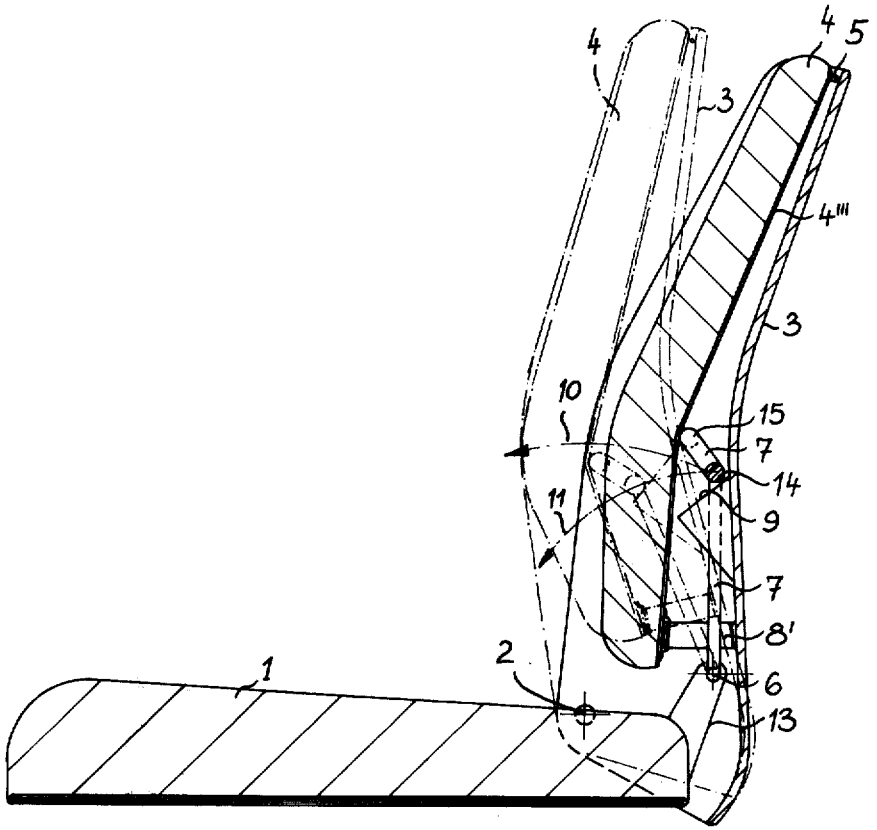
FIG. 2 is a view, analogous to FIG. 1 of a second embodiment in which the backrest is flexible.

The embodiment shown in FIG. 2 differs from the embodiment according to FIG. 1 in that there is no rigid backboard 4″. The rest of the mechanism, however, is unchanged. Instead of the rigid backboard 4″ the backrest 4 is provided with a flexible backboard 4‴. Thus the whole backrest 4 is flexible.

When the backplate 3 of this embodiment is pivotally moved, the base 4‴ of the backrest 4 is held by the connection 8, and the forward displacement of the crossbar 14 affects only the zone where the bow 15 contacts the backrest 4. The curvature of the zone 16 increases when the backplate is pivoted forwards, becoming more defined. Rearward movement of the backplate reduces the curvature of the zone 16 so that it becomes gradually flatter.

What we claim is:

1. A chair of the type having a seat and a pivotable backrest wherein said backrest includes:

a backplate pivotally supported to a frame, a backrest member forwardly of said backplate and secured adjacent its upper portion to said backplate, and means responsive to the pivotal movement of said backplate about its pivotal support for moving at least that portion of said backrest member which is disposed adjacent the sacro-lumbar region of a seat occupant by an amount in excess of that resulting from said pivotal movement alone, said responsive means moving said portion of said backrest member forwardly as the backrest is forwardly pivoted and moving said portion of said backrest member rearwardly as the backrest is rearwardly pivoted.

2. The chair of claim 1 in which said responsive means includes:

at least one arm pivotally supported between said backplate and said backrest member on a fixed pivot whose axis is parallel to the pivot axis of the backrest, and means on the free end of said arm and urged against said backrest member as the backrest is pivoted forwardly to move said portion of said backrest member forwardly relative to said backplate.

3. The chair of claim 1 which further includes means for urging said backrest member at its base toward said backplate.

4. The chair of claim 1 in which said backplate is curved.

5. The chair of claim 1 wherein said responsive means comprises a vertical rod pivoted at a fixed pivot point and secured at its upper end to a crossbar which is normal to the pivot plane, a guide surface mounted on said backplate for guiding said vertical rod, and means responsive to the movement of said rod as it moves relative to said guide surface as said backplate pivots for moving said backrest portion relative to said backplate.

6. The chair of claim 5 wherein the pivot point of said vertical rod is positioned rearwardly of said fixed pivot point of the backplate.

7. The chair of claim 6 wherein said crossbar abuts the rear surface of said backrest portion and the pivoting of both said backplate and said vertical rod vertically forward about their respective displaced pivots causes said crossbar to exert a force against said backrest portion to separate it from said backplate.

8. The chair of claim 5 wherein said rod is pivoted to a lug secured to said seat.

9. The chair of claim 1 wherein said backrest member has a rigid backboard.

10. The chair of claim 1 wherein said backrest member has a flexible backboard and said crossbar varies the curvature of flexible backboard as the backrest is pivoted.

11. The chair of claim 1 wherein said backrest member is pivoted to said backplate at its upper end.

12. The chair of claim 3 wherein said urging means comprises an elastic tape.

* * * * *